US011470931B2

(12) United States Patent
Davis

(10) Patent No.: US 11,470,931 B2
(45) Date of Patent: Oct. 18, 2022

(54) COMBINATION REMOVABLE COVER FOR PROTECTING LUGGAGE AND FOR SELECTIVELY CONVERTING LUGGAGE TO A BACKPACK

(71) Applicant: Wayne L. Davis, St. Petersburg, FL (US)

(72) Inventor: Wayne L. Davis, St. Petersburg, FL (US)

( * ) Notice: Subject to any disclaimer, the term of this patent is extended or adjusted under 35 U.S.C. 154(b) by 201 days.

(21) Appl. No.: 16/854,631

(22) Filed: Apr. 21, 2020

(65) Prior Publication Data

US 2020/0352294 A1 Nov. 12, 2020

Related U.S. Application Data

(60) Provisional application No. 62/920,533, filed on May 6, 2019.

(51) Int. Cl.
*A45C 7/00* (2006.01)
*A45F 4/00* (2006.01)

(52) U.S. Cl.
CPC ..... *A45C 7/0077* (2013.01); *A45C 7/0068* (2013.01); *A45F 2004/003* (2013.01)

(58) Field of Classification Search
CPC ..... A45C 7/0077; A45C 7/0068; A45F 2004/003
USPC ..... 224/153
See application file for complete search history.

(56) References Cited

U.S. PATENT DOCUMENTS 1,526,839 A * 2/1925 Dempsey ..... A45C 13/002 190/26
2,608,280 A * 8/1952 Stone ..... A45C 5/02 190/37
2,711,234 A * 6/1955 Rubens ..... A45C 13/002 190/26
2,724,467 A * 11/1955 Jaffe ..... A45C 13/002 190/26
3,314,464 A * 4/1967 Veilleux ..... B42D 3/045 150/154
3,901,360 A * 8/1975 Cook ..... A45C 13/002 190/26
4,065,343 A * 12/1977 Stumpe ..... A45C 13/42 156/212
4,941,196 A * 7/1990 Edelman ..... B65D 33/34 383/5
5,083,644 A * 1/1992 Collins, III ..... A45C 13/40 150/105
5,154,332 A * 10/1992 Williams ..... A45C 13/002 190/26

(Continued)

*Primary Examiner* — Peter N Helvey
(74) *Attorney, Agent, or Firm* — DP IP Group; Franco S. De Liguori

(57) ABSTRACT

A removable cover for protecting an article of luggage is provided. The cover has a tubular section with top and bottom open ends and two cover sections extending from respective opposite perimeter end edges of the tubular section for covering the top and bottom open ends of the tubular section. The tubular section is configured to be placed over and cover front, rear, top, bottom and sides of an article of luggage. In an exemplary embodiment, a rear side of the tubular section is provided with at least one compartment for storing shoulder straps and for allowing the shoulder straps to be readily removed from the compartment to allow the user to carry the luggage in the form of a backpack.

6 Claims, 11 Drawing Sheets

(56) References Cited

U.S. PATENT DOCUMENTS 5,172,795 A * 12/1992 Riceman ..... A45C 13/002 150/105
5,255,765 A * 10/1993 Schrecongost ..... A45C 13/002 150/154
5,293,975 A * 3/1994 Howorka ..... A45C 13/002 150/105
5,531,059 A * 7/1996 Dickinson ..... B65B 5/045 190/100
5,547,051 A * 8/1996 Bartscht ..... A45C 13/002 150/105
5,772,330 A * 6/1998 Bang ..... A45C 13/002 150/154
6,279,796 B1 * 8/2001 Trevino ..... A45C 13/002 150/154
6,364,365 B1 * 4/2002 Caplan ..... G09F 3/10 283/75
6,637,562 B2 * 10/2003 Oh ..... A45C 13/002 150/105
6,637,563 B1 * 10/2003 Ruckh ..... A45C 3/00 150/111
D513,879 S * 1/2006 Waples ..... D3/321
7,077,251 B1 * 7/2006 Gaither ..... A45C 13/002 150/105
7,093,699 B2 * 8/2006 Yu ..... A45C 13/002 150/154
7,195,158 B2 * 3/2007 White ..... A44B 15/005 235/384
7,441,641 B2 * 10/2008 Beakey ..... A45C 13/002 150/105
7,458,452 B2 * 12/2008 Beakey ..... A45C 13/002 150/105
8,469,249 B2 * 6/2013 Sugano ..... B62B 5/0023 224/576
D705,541 S * 5/2014 Harris ..... D3/318
D765,405 S * 9/2016 DeSerio ..... D3/318
10,159,322 B2 * 12/2018 Yu ..... A45F 3/04
D856,680 S * 8/2019 Acosta Favati ..... D3/318
10,485,314 B2 * 11/2019 Teran ..... A45C 5/14
2004/0206431 A1 * 10/2004 Metzig ..... A45C 5/14 150/154
2004/0238303 A1 * 12/2004 Hafif ..... A45C 5/143 190/18 A
2005/0005482 A1 * 1/2005 Araujo ..... B65D 33/34 40/6
2006/0086444 A1 * 4/2006 Yu ..... A45C 13/002 150/154
2007/0017764 A1 * 1/2007 Cheng ..... A45C 13/002 190/100
2007/0193667 A1 * 8/2007 Beakey ..... A45C 13/002 150/154
2007/0204943 A1 * 9/2007 Beakey ..... A45C 13/002 150/154
2007/0228096 A1 * 10/2007 Lin ..... A45C 9/00 224/576
2008/0036254 A1 * 2/2008 Clarke ..... A47C 31/11 297/225
2010/0270115 A1 * 10/2010 Seamon ..... A45C 13/002 190/26
2011/0259692 A1 * 10/2011 Warncke ..... A45C 13/18 190/124
2016/0331093 A1 * 11/2016 Licciardino ..... A45C 13/103
2018/0263345 A1 * 9/2018 Meersschaert ..... A45C 5/06

* cited by examiner

COMBINATION REMOVABLE COVER FOR PROTECTING LUGGAGE AND FOR SELECTIVELY CONVERTING LUGGAGE TO A BACKPACK

RELATED APPLICATION

This application claims the benefit of U.S. Provisional Patent Application No. 62/920,533, filed May 6, 2019.

BACKGROUND OF THE DISCLOSURE

Field of the Disclosure

The present disclosure relates generally to covers for articles of luggage. More particularly, the present disclosure relates to a combination removable cover for protecting an article of luggage and for selectively converting the luggage to a backpack to facilitate transportation of the luggage.

Description of the Related Art

Purchasing an article of luggage requires a significant investment. It is therefore important to protect luggage from wear-and-tear during use and from the natural elements, such as rain, in order to increase its useful life. While luggage covers have been proposed, such luggage covers are not designed for effective protection of luggage from normal wear-and-tear and the natural elements during use. Some existing removable luggage covers tend to be bulky and generally difficult to apply and remove from luggage. Existing luggage covers which are permanently attached (i.e., not removable from the luggage) have limited use in that they cannot be used with different articles of luggage.

Travelers are often required to move quickly while carrying luggage. For example, air travelers carrying luggage often need to move quickly through the airport, such as while moving though security and/or in order to reach their departure gate on time. Pushing and/or pulling one's luggage can and will slow a traveler down, especially when running late. In addition to being bulky and generally difficult to apply and remove, existing luggage covers of the removable type are not designed to provide assistance in carrying the luggage during use.

Therefore, the is a need for an improved removable luggage cover design providing effective protection to the luggage, such as from normal wear-and-tear and the natural elements, while being configured to be selectively converted to a backpack for assisting the user to carry the luggage.

SUMMARY OF THE DISCLOSURE

This disclosure is directed to an improved luggage cover that substantially obviates one or more of the problems due to limitations and disadvantages of the related art by providing a combination removable cover for protecting an article of luggage and for selectively converting the luggage to a backpack to facilitate transportation of the luggage.

An object of the present disclosure is to provide a luggage cover that can be easily applied on and removed from an article of luggage.

Another object of the present disclosure is to provide a luggage cover designed to provide effective protection to a luggage, such as from normal wear-and-tear and from the natural elements.

Yet another object of the present disclosure is to provide a luggage cover that can be selectively converted to a backpack during use to assist the user to carry the luggage.

Still another object of the present disclosure is to provide a luggage cover that is easy and inexpensive to manufacture and use.

To achieve these and other objects and advantages and in accordance with the purpose of the present disclosure, as embodied and broadly described, there is provided a combination removable cover for protecting an article of luggage and for selectively converting the luggage to a backpack to facilitate transportation of the luggage. The luggage cover is formed of a tubular section with top and bottom open ends and two cover sections extending from respective opposite perimeter end edges of the tubular section for covering the top and bottom open ends of the tubular section. The tubular section is configured to be placed over and cover front, rear, top, bottom and sides of a conventional article of luggage, such as a carry-on luggage.

The two cover sections include a first cover section configured to be disposed over the top side of the luggage and a second cover section configured to be disposed over the bottom side of the luggage. The first cover section includes one or more apertures to allow access to one or more handles of the luggage when the cover is applied on the luggage to allow a user to transport the luggage in a conventional manner. The second cover section is dimensioned to be disposed over the bottom side of the luggage while allowing access to wheels provided on the bottom side of the luggage to facilitate transportation of the luggage in a conventional manner while the cover is applied on the luggage.

Attached to the rear side of the tubular section is a pair of shoulder straps for selectively converting the luggage into a backpack during use of the cover. The rear side of the tubular section is also provided with at least one pocket or compartment for storing the shoulder straps and for allowing the shoulder straps to be readily removed from the compartment to allow the user to carry the luggage in the form of a backpack.

The tubular section may be optionally provided with one or more pockets or compartments for storing various personal items and/or electronic devices and/or accessories (e.g, iPad, laptop, phone and more) during use of the luggage cover. The compartments may be closed using any suitable fastener known to one of ordinary skill in the art, such as zippers, snaps, hook and loop fasteners or the like.

According to another feature of the embodiment, the luggage cover includes securing means for securely mounting the cover to the luggage. In one embodiment, the securing means comprises webbing straps and cooperating male/female side-release buckles provided at selected positions of the cover, including the tubular section and cover sections.

In one embodiment, the tubular section and two cover sections of the luggage cover are formed from a single piece of material. In an alternative embodiment, the tubular section and/or cover sections may be formed from multiple pieces of material integrally secured together using any conventional technique, such as by sewing. Likewise, the compartments and shoulder straps may be formed and attached to the corresponding tubular and cover sections by sewing or other suitable securing means.

In another embodiment, the luggage cover can be formed of any durable material, such as canvas, fabric, nylon, leather, plastic (e.g., vinyl), etc. The material may be a water-repellant and/or waterproof material to better protect the luggage cover from the natural elements.

The luggage cover of the present disclosure may be dimensioned to fit a wide range of luggage sizes, both small and large. For example, the luggage cover can be particularly adapted to cover and protect any legal-size airline carry-on luggage while it is being pushed or pulled through the airport.

The luggage cover of the present disclosure can optionally and readily be used to convert the luggage to a backpack to facilitate transportation of the luggage (e.g., hands free) whenever the user is in a hurry, such as while moving throughout the airport during travel. When the backpack is provided with additional compartments as noted above, the resulting combination is a luggage/backpack combination (e.g., two pieces of luggage in one) providing extra storage space for carrying items in a compact and efficient manner.

According to another feature, when not in use the luggage cover can be folded into a generally flat, compact configuration for easy storage (e.g., in the luggage itself).

According to the luggage cover of the present disclosure, the tubular configuration of the tubular section, including opposite open ends and corresponding cover sections, allows the luggage cover to be applied or removed from either the top or bottom of the luggage in a quick and efficient manner. The application and removal of the cover to and from the luggage is particularly facilitated by the use of a quick release connector mechanism, such as cooperating male/female side-release buckles.

The luggage cover of the present disclosure is configured to accommodate luggage both soft and hard and with two or four wheels so that the user is able to push or pull the luggage with ease.

BRIEF DESCRIPTION OF THE DRAWINGS

These and other features, aspects and advantages of the present disclosure will become better understood with regard to the following description, appended claims and accompanying drawings wherein:

DETAILED DESCRIPTION OF THE DISCLOSURE

Figure 1:
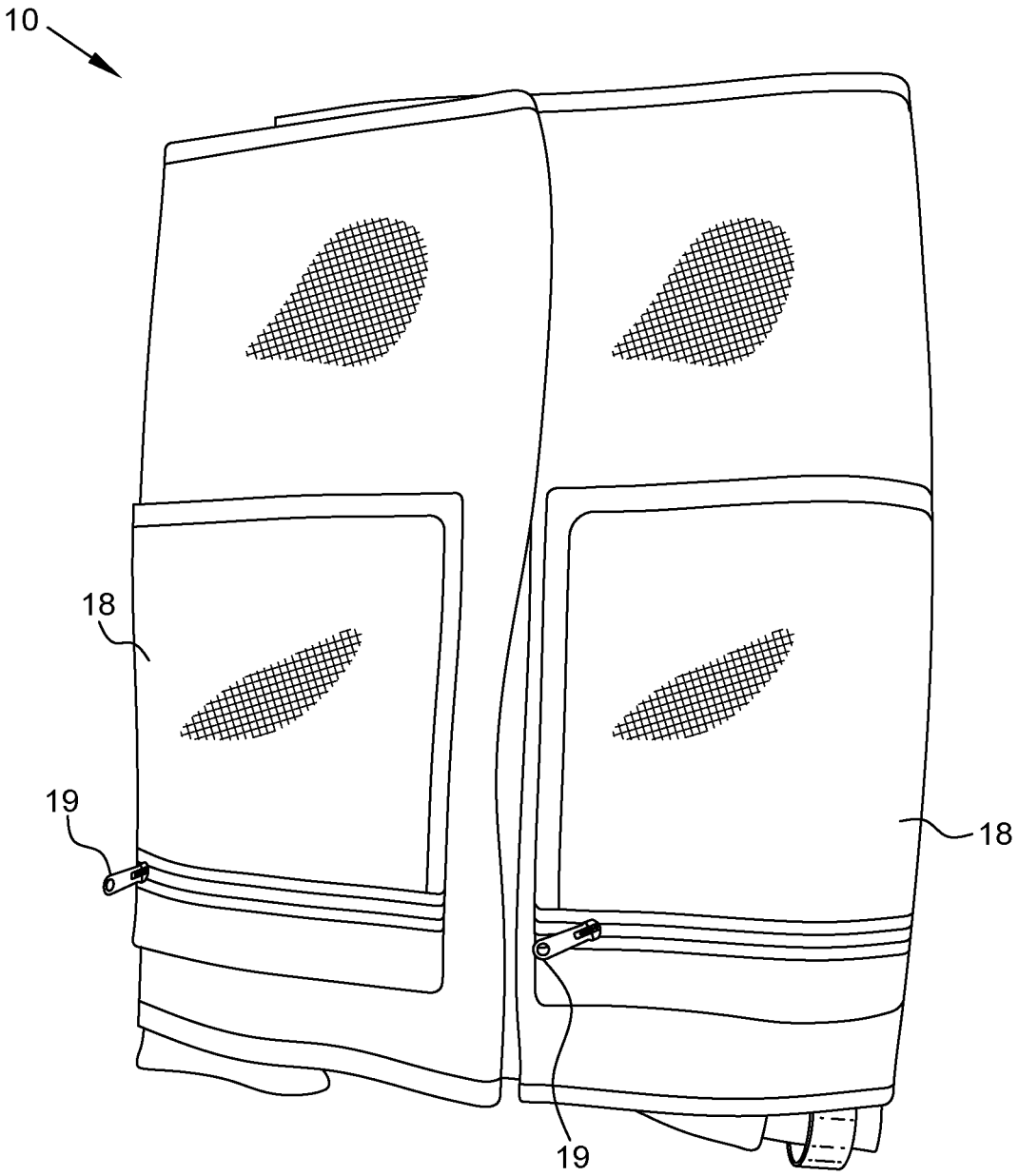
FIG. 1 is a front elevational view of a luggage cover according to an embodiment of the present disclosure, the luggage cover being shown in a generally flat, compact folded configuration.

The foregoing summary, as well as the following detailed description of preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangement and instrumentalities shown.

Figure 2:
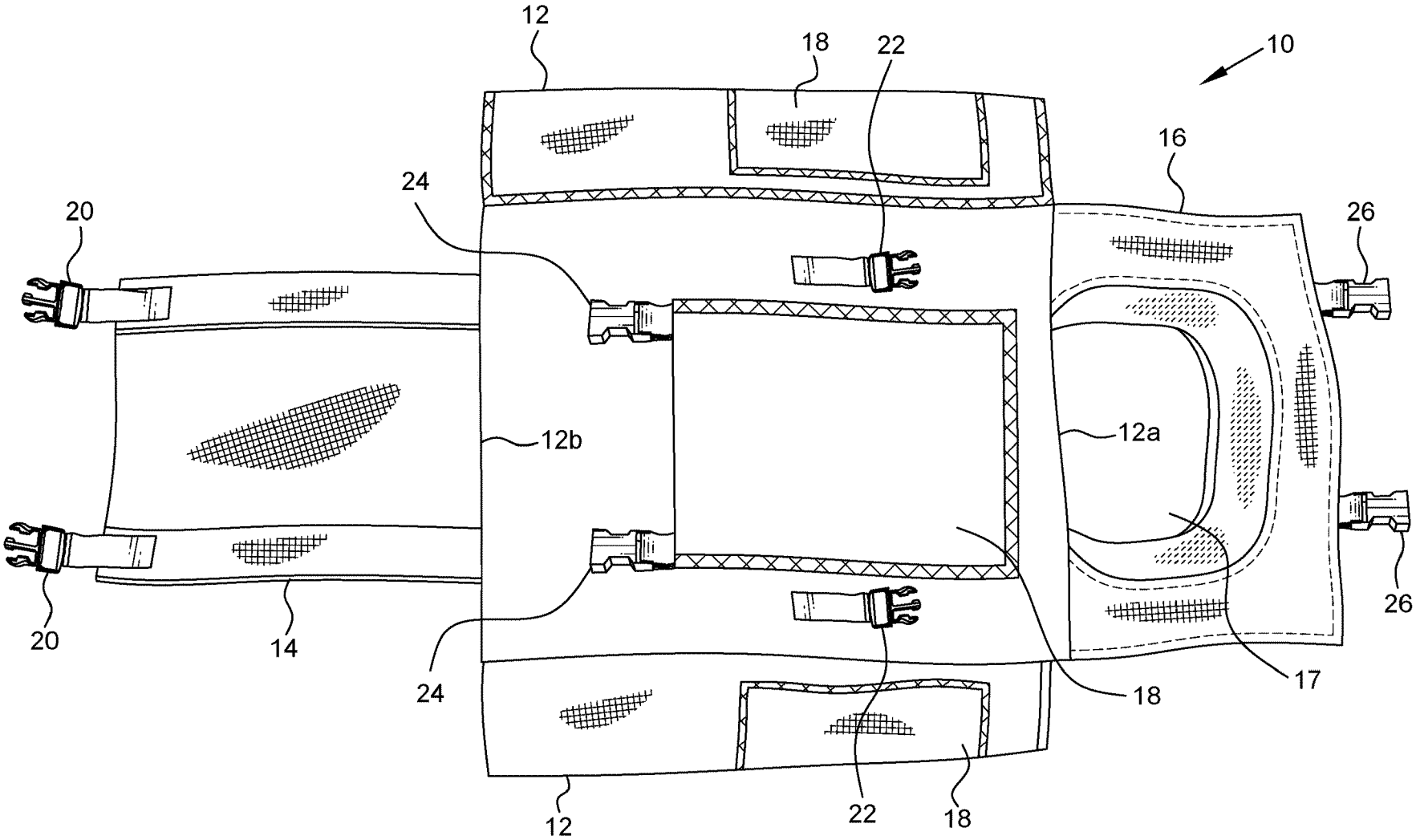
FIG. 2 is a top view of the luggage cover in an un-folded state, illustrating a front side of the tubular section.
Figure 3:
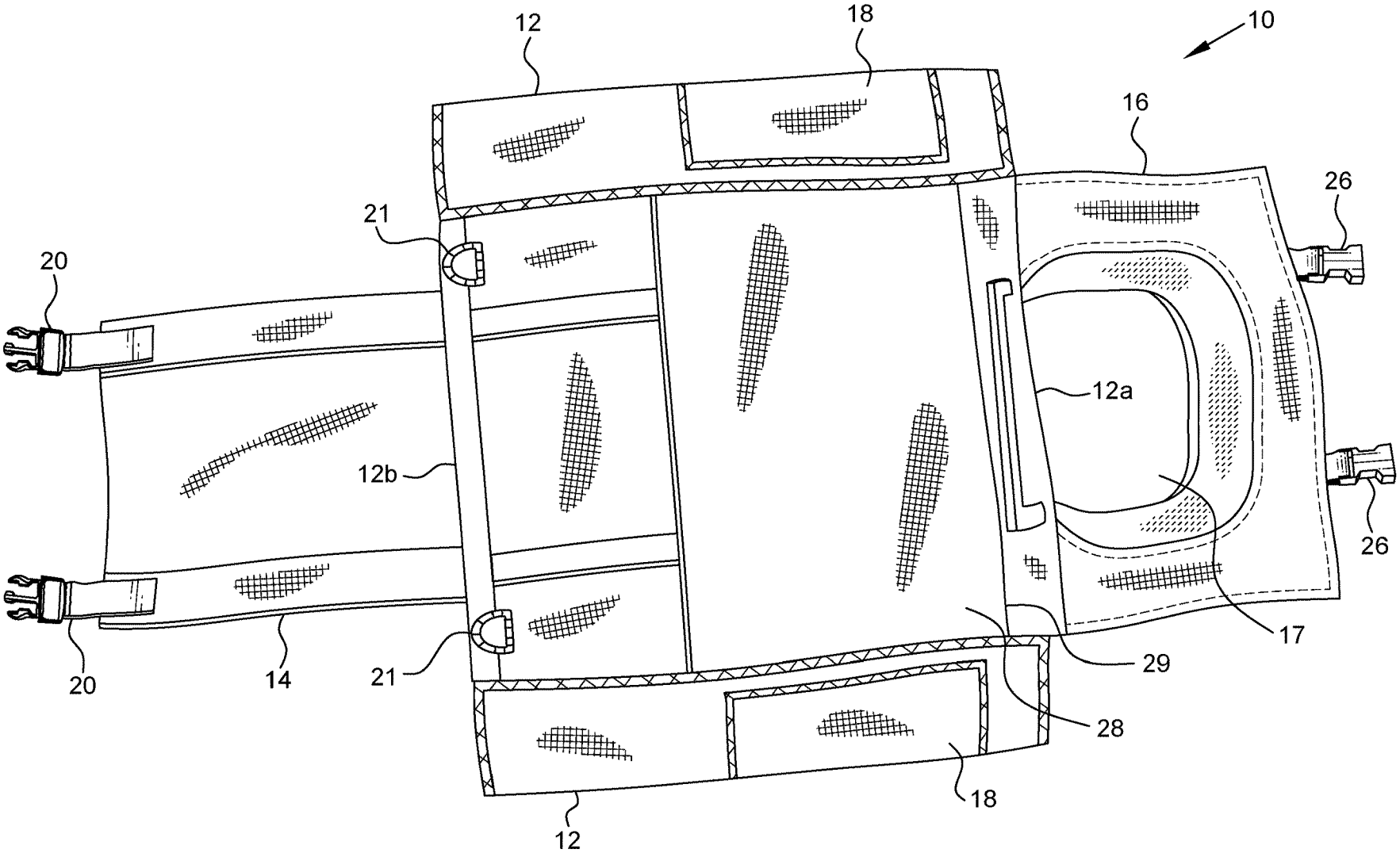
FIG. 3 is a top view of the luggage cover in an un-folded state, illustrating a rear side of the tubular section, with backpack straps (not shown) placed in a stored state inside a pocket or compartment of the tubular section of the luggage cover.
Figure 4:
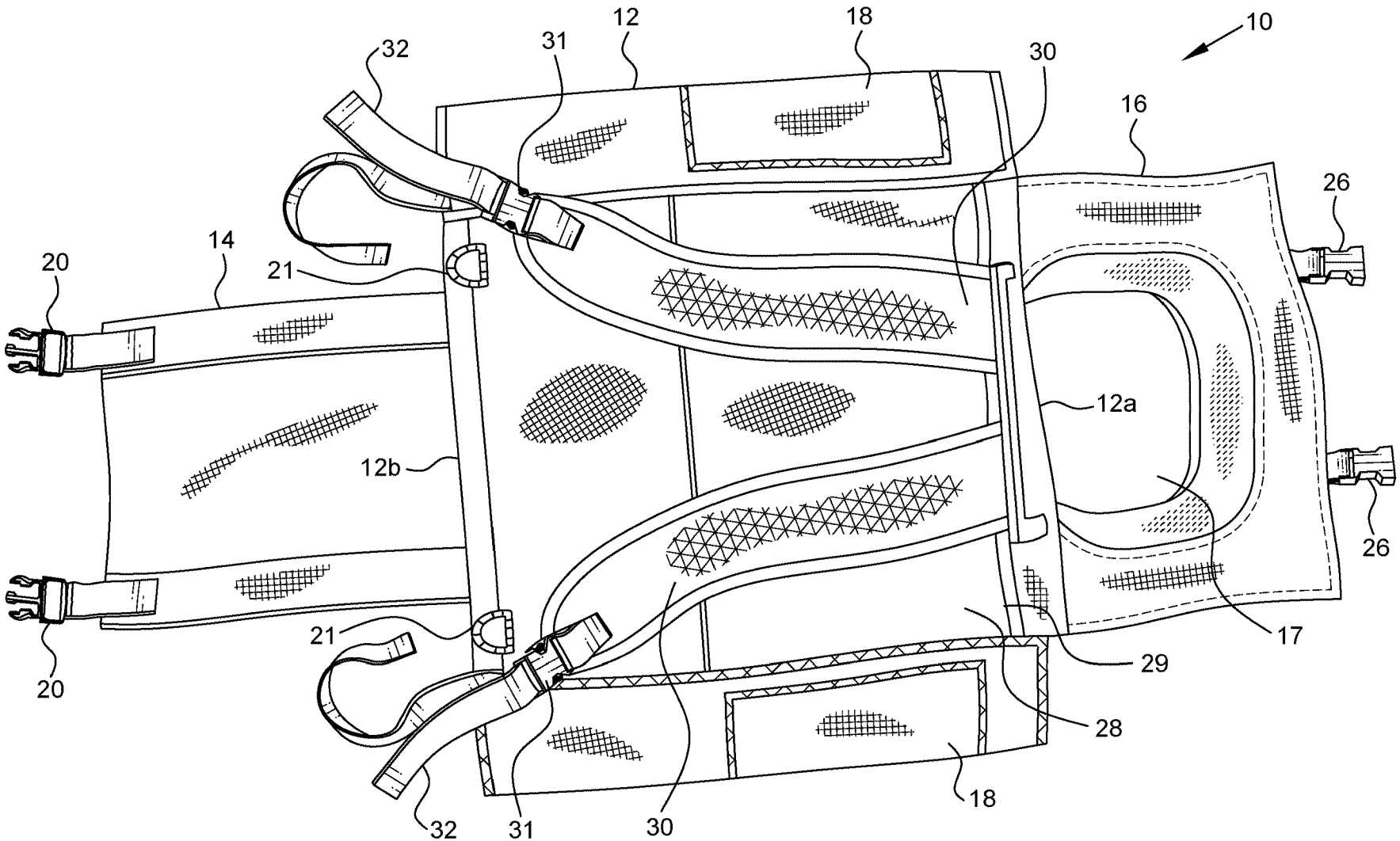
FIG. 4 is a view similar to FIG. 3, but with the backpack straps shown removed (pulled out) from the compartment and connected to straps attached to the tubular section via cooperating male/female buckle connectors.

FIG. 1 is a front elevational view of a luggage cover, generally designated at 10, according to an embodiment of the present disclosure. In FIG. 1, luggage cover 10 is shown in a generally flat, compact folded configuration. In this configuration, luggage cover 10 is adapted for and can be easily stored in a conventional luggage to which luggage cover 10 is applied during use, for example. FIGS. 2-4 illustrate luggage cover 10 in an un-folded state.

Referring to FIGS. 1-4, luggage cover 10 is formed of a tubular section 12 with top and bottom open ends 12*a*, 12*b* and two cover sections 14, 16 extending from respective opposite perimeter end edges of tubular section 12 for covering top and bottom open ends 12*a*, 12*b*. Tubular section 12 is configured to be placed over front, rear, top, bottom and sides of a conventional article of luggage, such as a carry-on luggage 40 as further described below with reference to FIGS. 5-11.

Cover section 14 is a first cover section configured to be disposed over the top of luggage 40, and cover section 16 is a second cover section configured to be disposed over the bottom of luggage 40. Cover section 14 has an aperture 17 to allow access to one or more handles 41, 42 of luggage 40 (FIGS. 5-11) when cover 10 is applied on luggage 40 to allow a user to transport luggage 40 in a conventional manner. Cover section 16 is dimensioned to be disposed over a bottom side of luggage 40 while allowing access to wheels 43 (FIGS. 10-11) provided on the bottom of luggage 40 to facilitate transportation of luggage 40 in a conventional manner while cover 10 is applied on luggage 40.

FIG. 3 is a top view of cover 10 in the un-folded state, illustrating a rear side of tubular section 12, with a pair of shoulder (backpack) straps disposed (stored) inside a pocket or compartment 28 of tubular section 12. FIG. 4 is a view similar to FIG. 3, but with backpack straps 30 shown removed (pulled out) from compartment 28.

Figure 5:
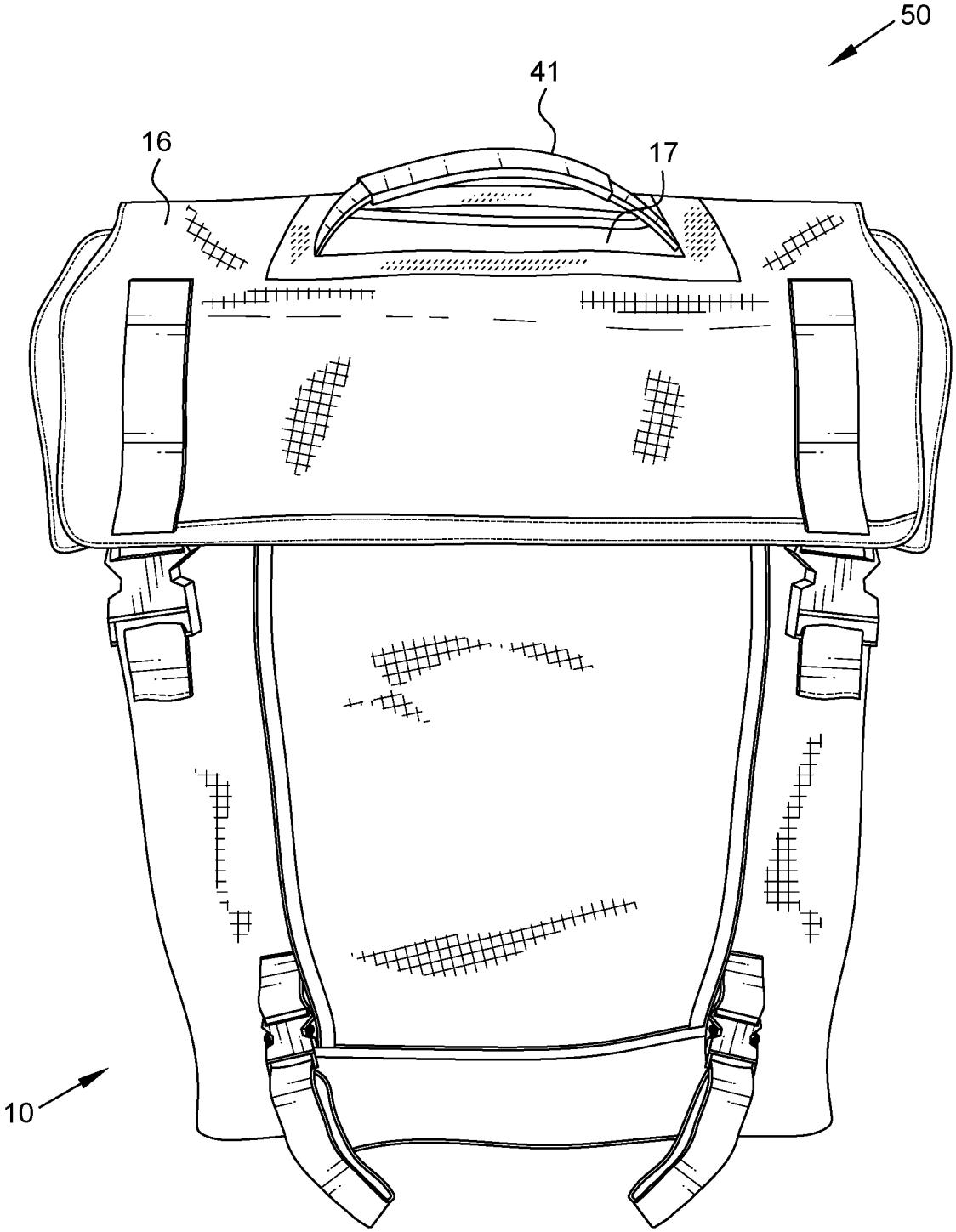
FIG. 5 is a front elevational view of the luggage cover of the present disclosure applied to a conventional carry-on luggage.
Figure 6:
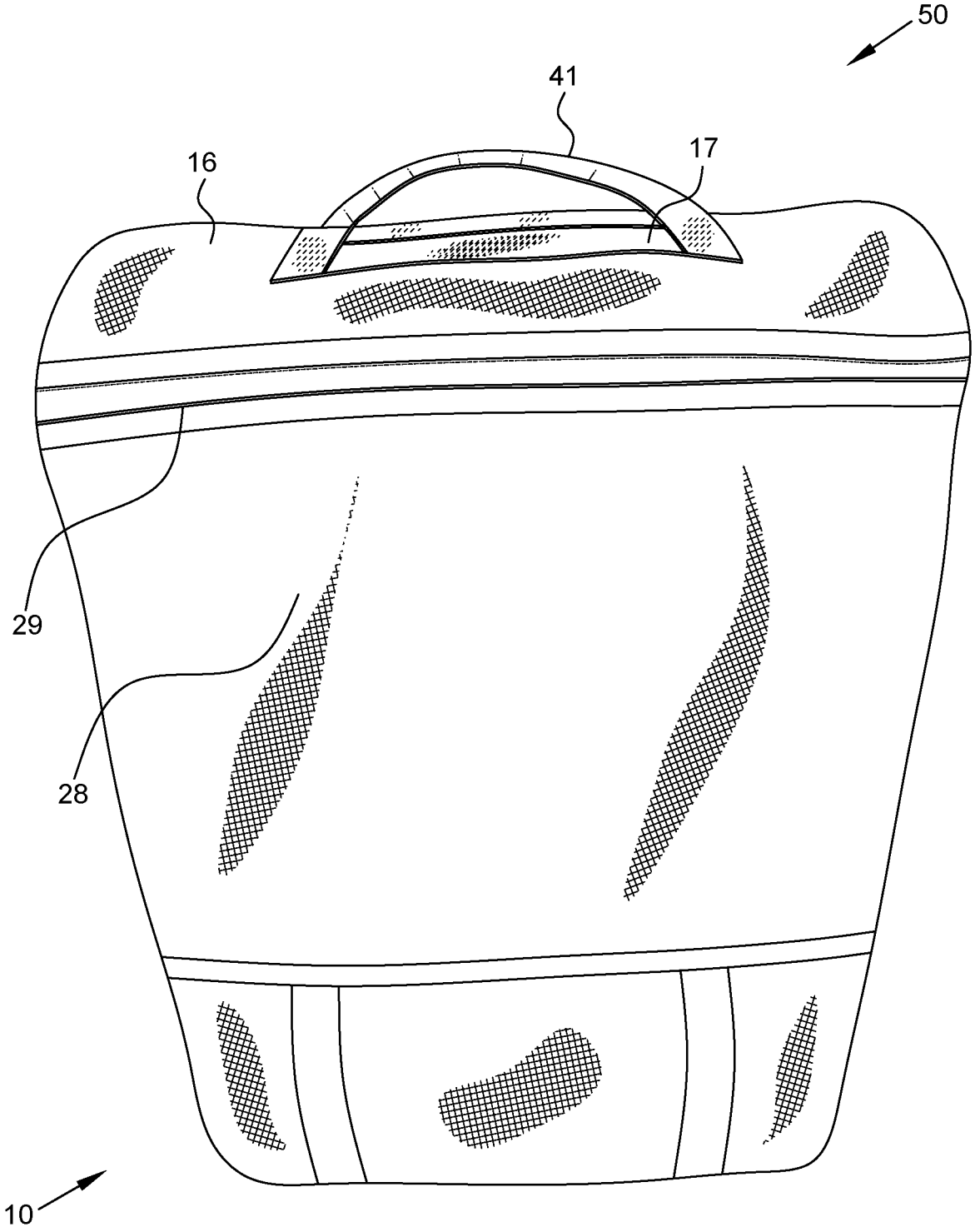
FIG. 6 is a rear elevational view of the luggage cover and conventional carry-on luggage combination shown in FIG. 5, with backpack straps (not shown) placed in a stored state inside a pocket or compartment of the tubular section of the luggage cover.
Figure 7:
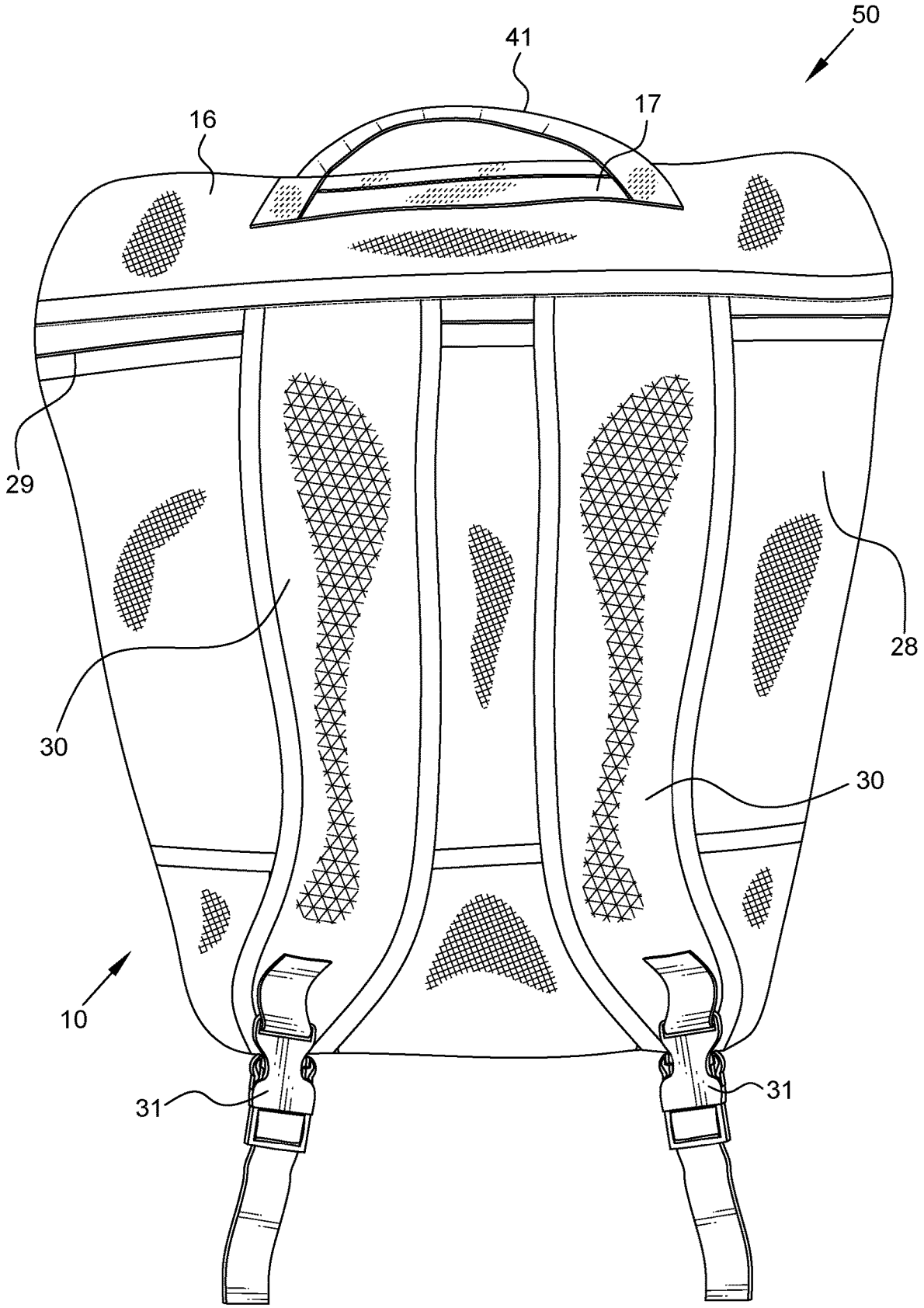
FIG. 7 is a view similar to FIG. 6, but with the backpack straps shown removed (pulled out) from the compartment and connected to straps attached to the tubular section via cooperating male/female buckle connectors. In this configuration the combined luggage cover and conventional luggage is ready to be transported entirely as a backpack.

FIG. 5 is a front elevational view showing a combination 50 according to the present disclosure in which cover 10 of the present disclosure is applied to conventional carry-on luggage 40. FIG. 6 is a rear elevational view of combination 50 shown in FIG. 5, with backpack straps 30 in a stored state inside compartment 28 of tubular section 12. FIG. 7 is a view similar to FIG. 6, but with backpack straps 30 shown removed (pulled out) from compartment 28 and connected to straps attached to the tubular section via cooperating male/female buckle connectors as further described below. In this configuration the cover 10 and luggage 40 combination is ready to be transported entirely as a backpack.

Backpack straps 30 are attached to the rear side of tubular section 12 for selectively converting luggage 40 into a backpack during use of cover 10. Compartment 28 and backpack straps 30 are configured so as to allow backpack straps 30 to be readily removed from compartment 28 via an opening 29 of compartment 28 to permit the user to carry luggage 40 in the form of a backpack. When not in use, backpack straps 30 can be readily stored inside compartment 28 via opening 29.

In this embodiment, tubular section 12 is provided with one or more additional pockets or compartments 18 for storing various personal items and/or electronic devices and/or accessories (e.g, iPad, laptop, phone and more) during use of cover 10. Compartments 18 may be closed using any suitable fastener known to one of ordinary skill in the art, such as zippers 19 as shown in FIG. 1. Other suitable fasteners include snaps, hook and loop fasteners or the like, without departing from the spirit and scope of the invention.

Cover 10 is provided with securing means for securely mounting cover 10 to luggage 40. In one embodiment, the securing means comprises webbing straps 32 and cooperating male/female side-release buckles 20, 22, 24, 26, 31 provided at selected positions of cover 10, including tubular section 12 and cover sections 14, 16 (FIGS. 2-5, 7-11). The securing means may also include D-shaped rings 21 (FIGS. 3-4).

In the present embodiment, tubular section 12 and/or cover sections 14, 16 are formed from multiple pieces of material integrally secured together using any conventional technique, such as by sewing. Compartments 18 and 28 and shoulder straps 30 are formed and secured to corresponding tubular and cover sections 12, 14, 16 by sewing or other suitable securing means. Alternatively, tubular section 12 and cover sections 14, 16 may be formed from a single piece of material.

Cover 10 can be formed of any durable material, such as canvas, fabric, nylon, leather, plastic (e.g., vinyl), etc. The material may be a water-repellant and/or waterproof material to better protect cover 10 from the natural elements.

Cover 10 may be dimensioned to fit a wide range of luggage sizes, both small and large. For example, cover 10 can be particularly adapted to cover and protect any legal-size airline carry-on luggage while it is being pushed or pulled through the airport.

According to a feature of the present disclosure, cover 10 can optionally and readily be used to convert luggage 40 to a backpack (FIG. 7) to facilitate transportation of luggage 40 (e.g., hands free) whenever the user is in a hurry, such as while moving throughout the airport during travel. When the backpack is provided with additional compartments as noted above, the resulting combination 50 (FIGS. 5-7) is a luggage/backpack combination (e.g., two pieces of luggage in one) providing extra storage space for carrying items in a compact and efficient manner.

Figure 8:
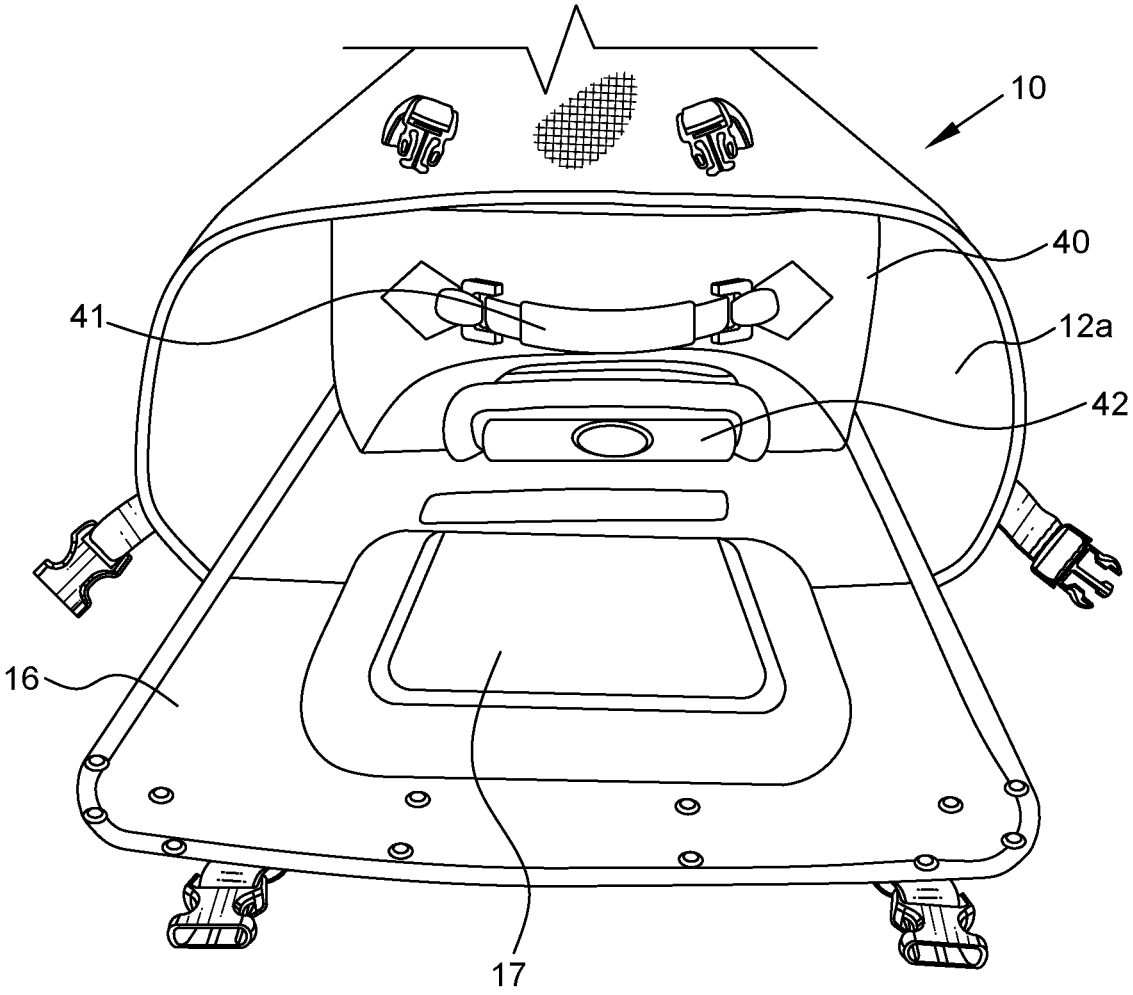
FIG. 8 is a partial perspective view illustrating the luggage cover of the present disclosure in the process of being applied to a conventional luggage (i.e., the luggage is partially inserted into the tubular section of the luggage cover), with the first cover section of the luggage cover shown in an open state to expose the top open end of the luggage cover to show the top of the luggage.
Figure 9:
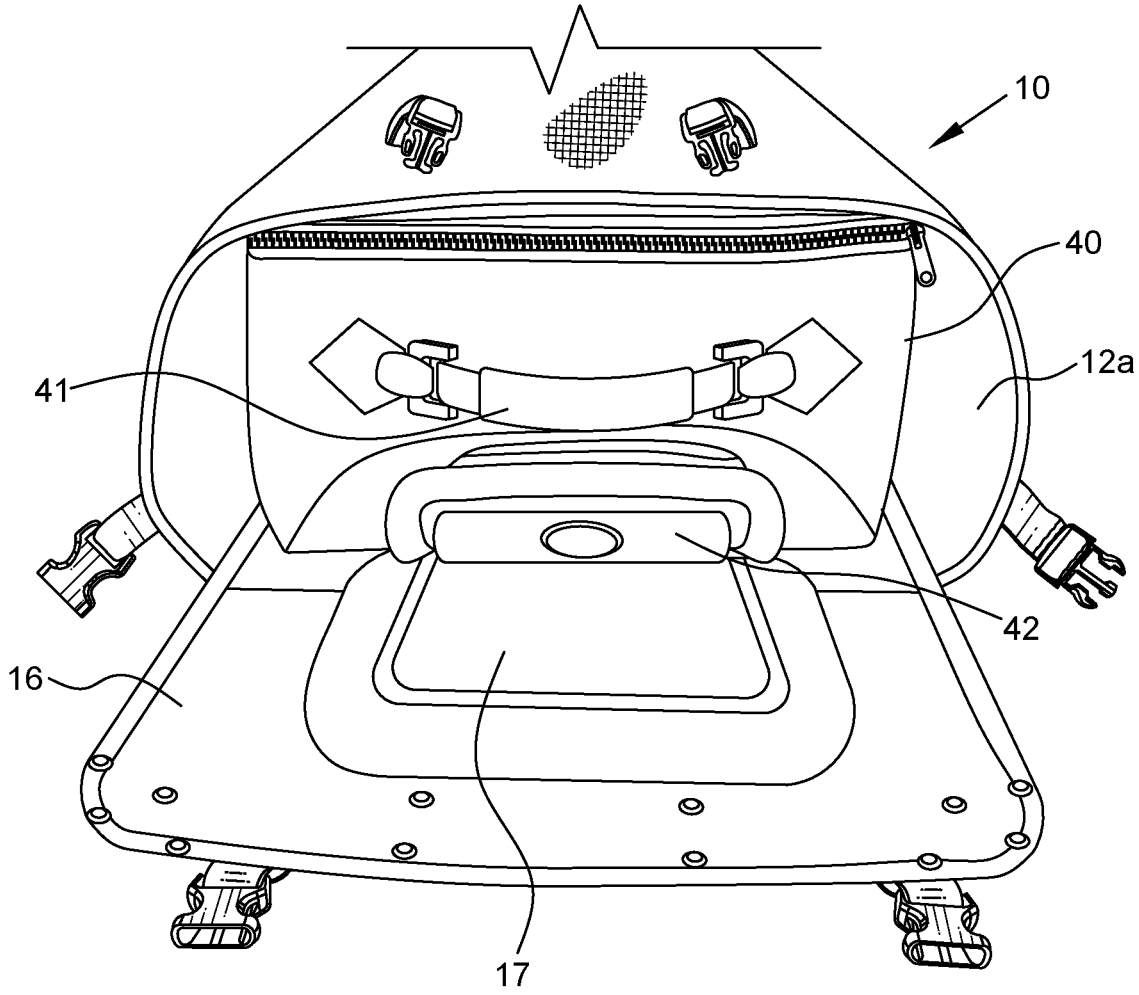
FIG. 9 is a view similar to FIG. 8, but with the luggage being completely inserted into the tubular section of the luggage cover.

FIGS. 8-11 illustrate exemplary embodiments for applying cover 10 to luggage 40. FIGS. 8-9 are partial perspective views illustrating cover 10 being applied to luggage 40 by tubular section 12 being disposed over the top of luggage 40 through open end 12*b*. In FIG. 8, luggage 40 is shown partially inserted into tubular section 12 with cover section 16 shown in an open state and exposing the top of luggage 40 including handles 41, 42. In FIG. 9, luggage 40 is shown completely inserted into tubular section 12 and prior to cover section 16 being folded over to close open end 12*a* of tubular section 12 and corresponding buckle elements being connected together.

Figure 10:
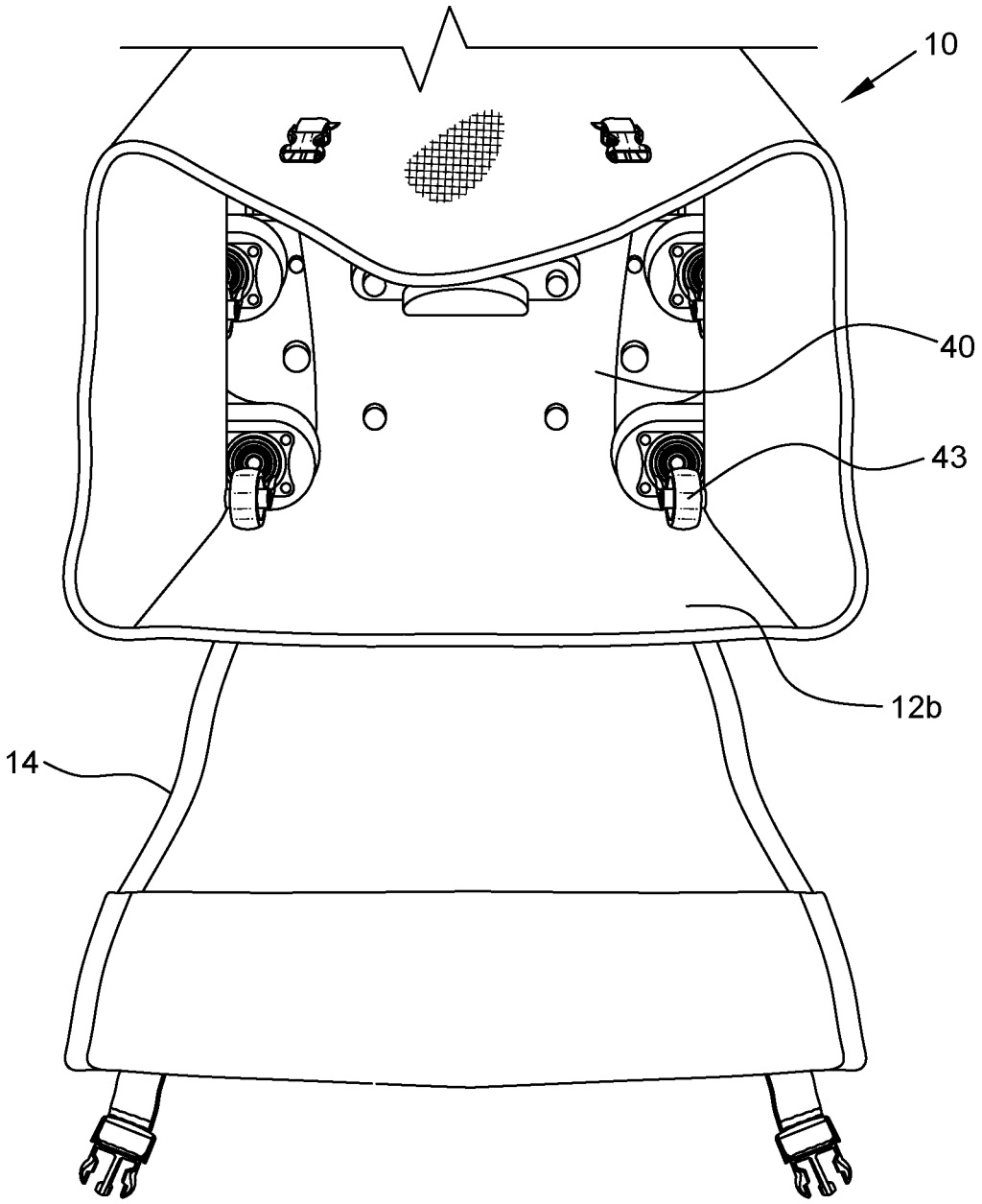
FIG. 10 is a partial perspective view illustrating the luggage cover of the present disclosure in the process of being applied to a conventional luggage (i.e., the luggage is partially inserted into the tubular section of the luggage cover), with the second cover section of the luggage cover shown in an open state to expose the bottom open end of the luggage cover to show the bottom of the luggage.
Figure 11:
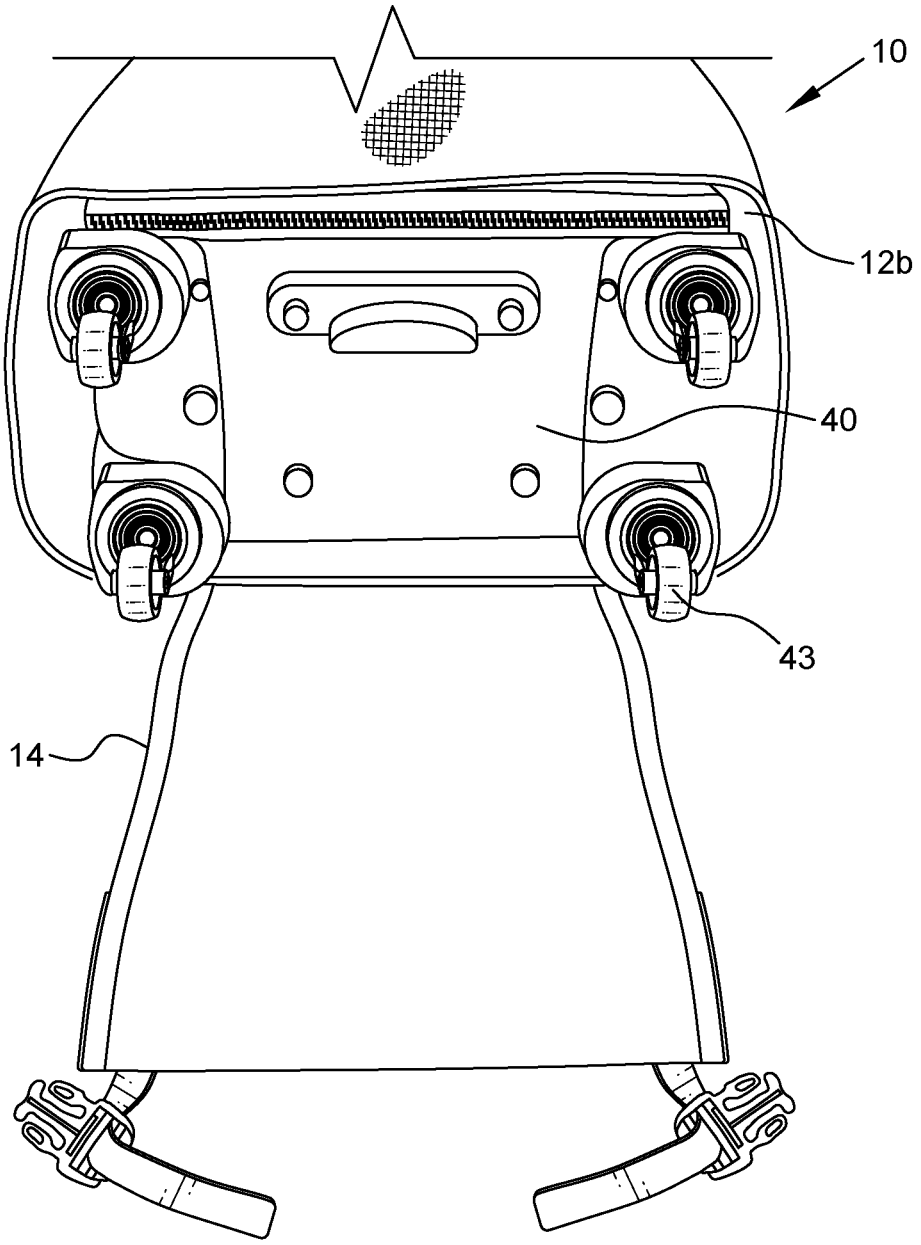
FIG. 11 is a view similar to FIG. 10, but with the luggage being completely inserted into the tubular section of the luggage cover.

FIGS. 10 and 11 are partial perspective views illustrating cover 10 being applied to luggage 40 by tubular section 12 being disposed over the bottom of luggage 40 through open end 12*a*. In FIG. 10, luggage 40 is shown partially inserted into tubular section 12 with cover section 14 shown in an open state and exposing the bottom of luggage 40 including wheels 43. In FIG. 11, luggage 40 is shown completely inserted into tubular section 12 and prior to cover section 14 being folded over to close open end 12*b* of tubular section 12 and corresponding buckle elements being connected together.

FIGS. 5-7 illustrate cover 10 completely applied and secured to luggage 40 in accordance with the procedure described below with respect to FIGS. 8-11, including handle 41 of luggage 40 extending through opening 17 of cover section 16. Although not shown in FIGS. 5-7, wheels 43 of luggage 40 are configured to be exposed from bottom open end 12*b* of tubular section 12 in the configuration shown in FIGS. 5-7. FIG. 7 shows combination 50 in which the combined cover 10 and luggage 12 can be readily transported as a backpack as described above.

By the foregoing configuration of cover 10 according to the present disclosure, the tubular configuration of tubular section 12, including opposite open ends 12*a*, 12*b* and corresponding extending cover sections 14, 16, allows cover 10 to be conveniently applied to and removed from either the top or bottom of luggage 40 in a quick and efficient manner. The application and removal of cover 10 to and from luggage 40 is particularly facilitated by the use of the disclosed quick release connector mechanism, such as cooperating male/female side-release buckles.

The luggage cover of the present disclosure is configured to accommodate luggage both soft and hard and with two or four wheels so that the user is able to push or pull the luggage with ease.

By the disclosure in the foregoing description and corresponding drawing figures, it can be appreciated that the luggage cover of the present disclosure can be easily applied on and removed from an article of luggage. The luggage cover is designed to provide effective protection to a luggage, such as from normal wear-and-tear and from the natural elements. Furthermore, the luggage cover can be selectively converted to a backpack during use to assist the user to carry the luggage, and is durable and easy and inexpensive to manufacture and use.

The previous description of the disclosed exemplary embodiments is provided to enable any person skilled in the art to make or use the present disclosure. Various modifications to these exemplary embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

What is claimed is:

1. A removable cover for protecting an article of luggage, comprising: a tubular section with top and bottom open ends and two cover sections extending from respective opposite perimeter end edges of the tubular section for covering the top and bottom open ends of the tubular section, the tubular section being configured to be placed over and cover front, rear, top, bottom and sides of an article of luggage; a pair of shoulder straps attached to the rear side of the tubular section for selectively converting the luggage into a backpack; and securing means for securely mounting the cover to the luggage;

wherein the two cover sections include a first cover section configured to be disposed over the top side of the luggage and a second cover section configured to be disposed over the bottom side of the luggage;

wherein the first cover section includes one or more apertures to allow access to one or more handles of the luggage when the cover is applied on the luggage to allow a user to transport the luggage;

wherein the second cover section is dimensioned to be disposed over the bottom side of the luggage while allowing access to wheels provided on the bottom side of the luggage to facilitate transportation of the luggage while the cover is applied on the luggage;

wherein the rear side of the tubular section is provided with at least one compartment for storing the shoulder straps and for allowing the shoulder straps to be readily removed from the compartment to allow the user to carry the luggage in the form of a backpack; and wherein the securing means comprises one pair of one of male and female side-release buckles that is secured directly to and extends from the first cover section for corresponding releasable connection to a pair of the other of the male and female side-release buckles of the one pair that is secured directly to and extends from the tubular section, and another pair of one of male and female side-release buckles that is secured directly to and extends from the second cover section for corresponding releasable connection to a pair of the other of the male and female side-release buckles of the another pair that is secured directly to and extends from the at least one compartment at the rear side of the tubular section.

2. The removable cover of claim 1, wherein the luggage is a carry-on luggage.

3. The removable cover of claim 1, wherein the tubular section is provided with one or more compartments for storing various personal items and/or electronic devices and/or accessories during use of the cover.

4. The removable cover of claim 1, wherein the tubular section and two cover sections are formed of a durable material.

5. The removable cover of claim 4, wherein the durable material is waterproof.

6. The removable cover of claim 4, wherein the durable material is a material selected from the group consisting of canvas, fabric, nylon, leather and plastic.

* * * * *